US008020496B1

(12) United States Patent
Maysonet

(10) Patent No.: US 8,020,496 B1
(45) Date of Patent: Sep. 20, 2011

(54) RETRACTABLE PLATFORM DEVICE FOR USE WITH SUBWAY TRAINS AND ASSOCIATED METHOD

(76) Inventor: Ignacio Maysonet, Bronx, NY (US)

( * ) Notice: Subject to any disclaimer, the term of this patent is extended or adjusted under 35 U.S.C. 154(b) by 257 days.

(21) Appl. No.: 12/381,828

(22) Filed: Mar. 17, 2009

Related U.S. Application Data

(60) Provisional application No. 61/069,624, filed on Mar. 17, 2008.

(51) Int. Cl.
*B61D 47/00* (2006.01)
*B61D 23/00* (2006.01)

(52) U.S. Cl. ..... 105/425; 105/449

(58) Field of Classification Search ..... 105/425, 105/436, 437, 438, 443, 449, 458; 14/69.5, 14/71.1, 72.5
See application file for complete search history.

(56) References Cited

U.S. PATENT DOCUMENTS

| | | | | |
|---|---|---|---|---|
| 1,098,298 | A | 5/1914 | Porth | |
| 1,216,560 | A | 2/1917 | Gallinant | |
| 4,188,889 | A * | 2/1980 | Favrel | 105/445 |
| 5,357,869 | A * | 10/1994 | Barjolle et al. | 105/436 |
| 5,517,921 | A | 5/1996 | Klohn | |
| 5,775,232 | A * | 7/1998 | Golemis et al. | 105/458 |
| 6,167,816 | B1 * | 1/2001 | Lavery et al. | 105/458 |
| 6,352,034 | B1 * | 3/2002 | Bolliger et al. | 104/53 |
| 2009/0106918 | A1 * | 4/2009 | Van Roosmalen et al. | 14/69.5 |

* cited by examiner

*Primary Examiner* — Joe Morano, IV
*Assistant Examiner* — R. J. McCarry, Jr.

(57) ABSTRACT

The device would be a metal or heavy-duty plastic retractable loading platform, designed to bridge the gap between the train car and the station platform. When not in use, the retractable platform would be retracted into a position of concealment beneath the door(s) of the train car. At the station, the device would move outward, either abutting or overlapping the station platform, just prior to the train door(s) opening.

8 Claims, 5 Drawing Sheets

RETRACTABLE PLATFORM DEVICE FOR USE WITH SUBWAY TRAINS AND ASSOCIATED METHOD

CROSS REFERENCE TO RELATED APPLICATIONS

This application claims the benefit of U.S. Provisional Application No. 61/069,624, filed Mar. 17, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to retractable platforms and, more particularly, to an automated retractable platform device for bridging a gap between a train and a station platform during passenger loading and unloading procedures.

2. Prior Art

America in the 21$^{st}$ century is a nation of commuters. Most of us work someplace outside the home, and for most of us, that place lies somewhere down the highway. For commuters who live in the suburbs or, increasingly, the farther removed "exurbs," the commute can be extreme. It is not uncommon for a person employed in San Francisco to live in Modesto or Gilroy, and drive several hours twice a day; and similarly highway-bound existences can be found on the ever-receding peripheries of any'major city. Still, with all the news about road-rage, traffic jams, and the mounting hassles of the commuter lifestyle, we may forget that millions of Americans commute in another manner—by train. Trains offer certain advantages when it comes to the morning and evening commute.

For one thing, it's entirely possible to read the newspaper on the morning train and take a nap on the evening commute. The countryside reels past, the click of the wheels on the tracks instills a reassuring rhythm in the mind and body, and the train proceeds (on most days) like clockwork, traveling down its accustomed track by predestination. On a commuter train, one can relax and prepare for—or forget, once they've been met—the demands of the business day. The commuter brethren on the highway, meanwhile, are engaged in a heart-pounding, high-stakes game that is equal parts patience and aggression; small wonder that they come home exhausted and irritable, hands shaking until the first cocktail is down. Given the choice, what veteran of the highway commute would not prefer the train?

Then again, commuting by train or subway does have its downside. For one thing, the train commuter must navigate among a sea of strangers each morning and evening, generally at times when he or she most craves silence and solitude. For subway commuters, this lack of privacy and personal space is extreme, as one is frequently shoulder-to-shoulder, standing in a closely packed crowd of fellow riders. On trains, one's seatmate is often a stranger, and not always a polite or agreeable one.

And then there is the rush out the doors when the train reaches the platform or station—"people pushing, people shoving," as one rock-n-roll song put it, "on the 8:15 into the city." On top of all this, there is the very real hazard involved in actually stepping off the train and onto the platform. You have to consciously step out, or risk falling between the train and the concrete—a mistake that could be the ruin of your day, certainly, if not your life. In the hurly-burly of the commute, people do in fact fall and get injured between trains and platforms, a problem that the present invention will solve.

Platform gaps, up to 15 inches wide, can be caused by a station's curvature and the design of trains, whose sides are straight. Fliers, posters and yellow stickers on train doors urge riders to "Watch the Gap." Subway and commuter train stations are busy, crowded places where large groups of people are constantly in motion, and frequently in motions opposed to one another. Scrambling to get aboard a train, or attempting to get off at the station, a passenger frequently finds himself or herself in an anxious, distracted state of mind—a state more likely to lead to a potentially catastrophic misstep.

Accordingly, the present invention is disclosed in order to overcome the above noted shortcomings. The retractable platform device is convenient and easy to use, lightweight yet durable in design, and designed to assist train passengers with entering and exiting the train.

BRIEF SUMMARY OF THE INVENTION

In view of the foregoing background, it is therefore an object of the present invention to provide a retractable loading platform assembly for bridging a gap between a train and a station platform during passenger loading and unloading procedures. These and other objects, features, and advantages of the invention are provided by a retractable loading platform assembly preferably including a rigid loading platform adapted to be anchored to an underside of the train, and a mechanism for automatically reciprocating the loading platform along a linear travel path upon detecting first and second triggering events respectively.

In a preferred embodiment, the loading platform may be automatically displaced from a retracted position to a fully extended position when the first triggering event is detected. Likewise, the loading platform may be automatically displaced from the fully extended position to the retracted position when the second triggering event is detected. Such a linear travel path is preferably defined along a single horizontal plane.

The automatic loading platform reciprocating mechanism may include a power-actuated drive mechanism centrally engaged to a bottom surface of the loading platform. Such a drive mechanism may be connected to the underside of the train. The mechanism further includes a controller preferably includes a processor and a memory electrically coupled thereto. A plurality of sensor may be located at the loading platform and being communicatively coupled to the controller respectively. In this manner, the controller may cause the drive mechanism to toggle between alternate operating modes upon detecting the first and second triggering events respectively.

Such a memory preferably includes programmable software instructions that cause the controller to verify an authenticity of the first and second triggering events. Upon detecting the first and second triggering events, a first group of the sensors generates and transmits true first output signals. Similarly, a second group of the sensors may generate and transmit true second output signals upon detecting the second triggering event respectively. Such first and second sensor groups preferably generate and transmit respective first and second false output signals when the first and second triggering events are not detected.

The controller may be responsive to the first and second outputs signals and thereby generates and transmits first and second control signals to the drive mechanism upon receiving the true first and second output signals respectively.

In this manner, the drive mechanism is caused to rotate in clockwise and counter clockwise directions upon receiving the first and second control signals respectively.

In one embodiment, drive mechanism preferably includes a rotary motor coupled to an existing power source of the train, and a plurality of rectilinear drive shafts directly coupled to the rotary motor respectively. Each of such drive shafts may be coupled to the rotary motor and oppositely extend away therefrom respectively. Notably, the drive shafts may be registered along a linear axis oriented parallel to a rear edge of the loading platform.

The drive mechanism may further include a plurality of cogwheels anchored to respective distal ends of the drive shafts. Each of such cogwheels may be synchronously rotated with the drive shafts as the motor rotates in the clockwise and counter clockwise directions. A plurality of serrated tracks may be statically connected directly to the bottom surface of the loading platform. Such serrated tracks are preferably configured in such a manner that the cogwheels remain continuously and directly engaged with the serrated tracks during the reciprocating motions. In this manner, the loading platform is caused to linearly reciprocate along the horizontal plane as the drive shafts and the cogwheels rotate along the clockwise and counter clockwise directions respectively.

The automatic loading platform reciprocating mechanism may further include a plurality of protective guide rails situated at opposed lateral ends of the loading platform respectively. A plurality of guide wheels may be rotatably anchored within each of the protective guide rails. Such guide wheels are preferably configured in such a manner that the loading platform remains intercalated between top and bottom rows of the guide wheels while reciprocating between the retracted and fully extended positions respectively.

In one embodiment, each of the protective guide rails has a longitudinal length registered parallel to the linear travel path of the loading platform for maintaining the loading platform at a substantially stable position during repeated reciprocating movement.

For any hurried commuter—and especially for those elderly or mobility-restricted commuters for whom these transitions are a particular obstacle—the retractable platform device would provide a convenient, reliable safety bridge between train and platform, platform and train.

The present invention further includes a method of utilizing a retractable loading platform assembly for bridging a gap between a train and a station platform during passenger loading and unloading procedures. Such a method preferably includes the chronological steps of: providing and anchoring a rigid loading platform to an underside of the train; and automatically reciprocating the loading platform along a linear travel path upon detecting first and second triggering events respectively. The later step may be executed by performing the following chronological steps: automatically displacing the loading platform from a retracted position to a fully extended position when the first triggering event is detected; and automatically displacing the loading platform from the fully extended position to the retracted position when the second triggering event is detected. Such a linear travel path is preferably defined along a single horizontal plane.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
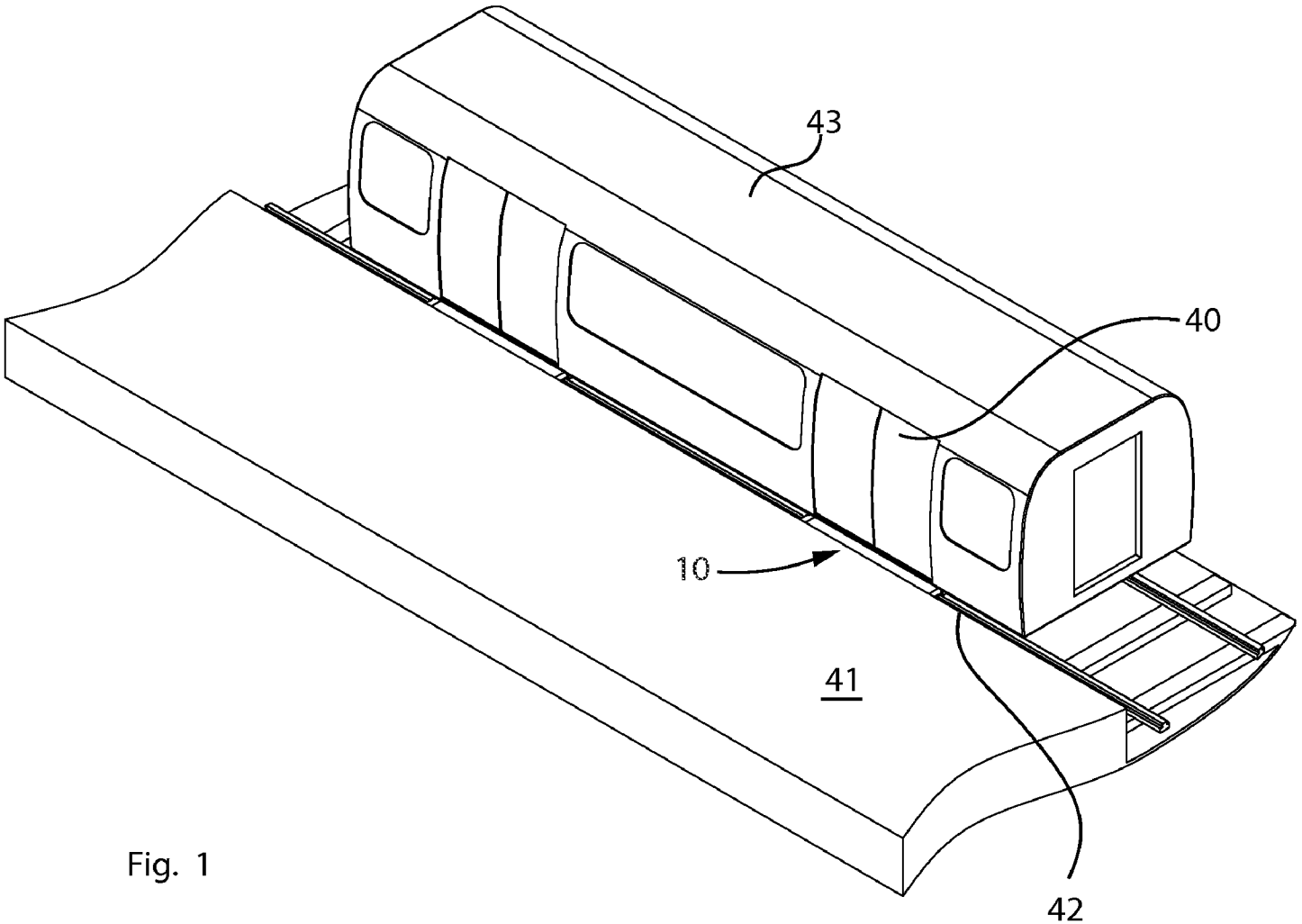
FIG. 1 is a perspective view showing an exemplary environment at which an automated retractable platform device is employed, in accordance with the present invention.
Figure 2:
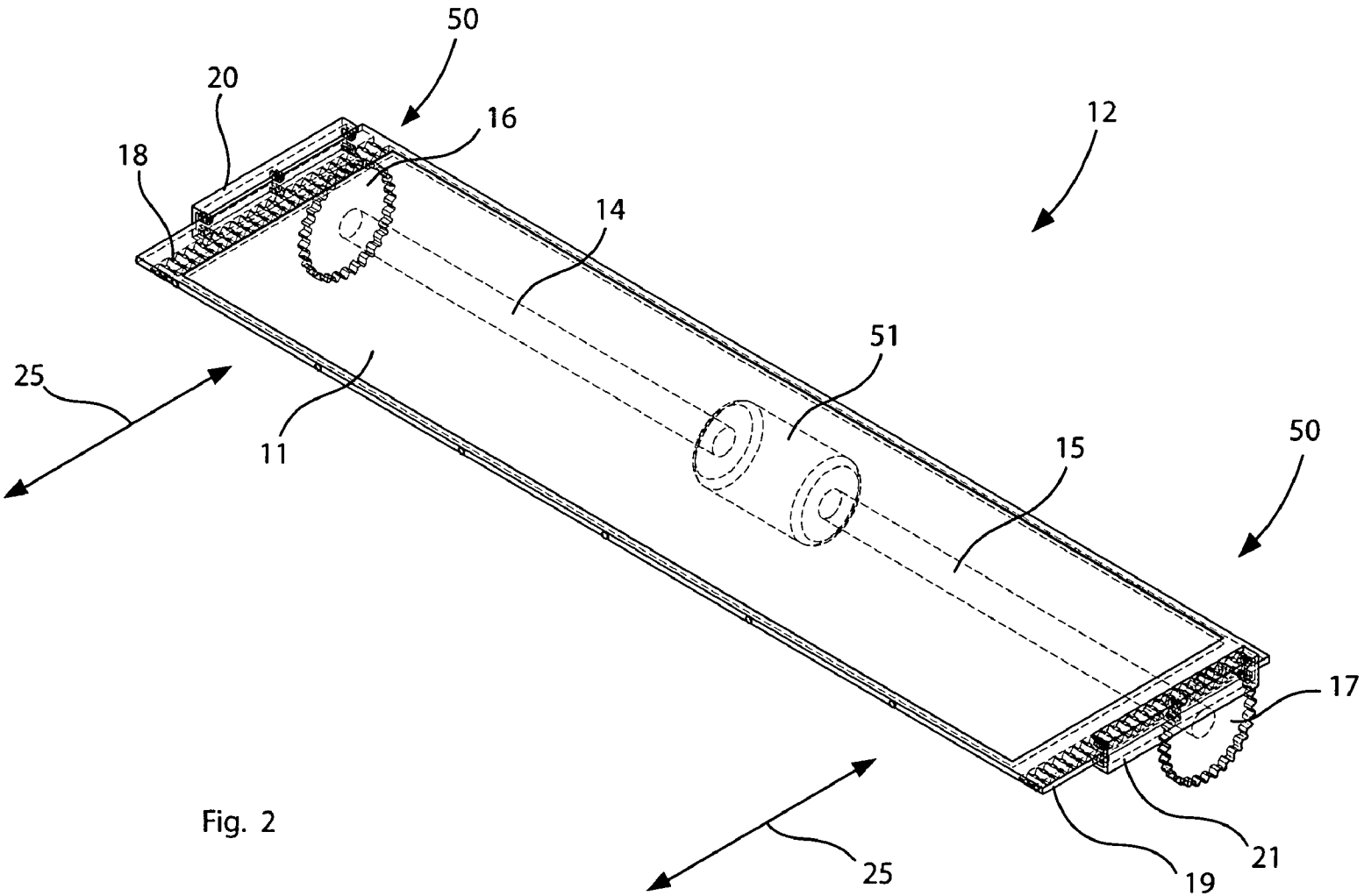
FIG. 2 is a perspective view showing a platform operably supported by an automated loading platform reciprocating mechanism.
Figure 3:
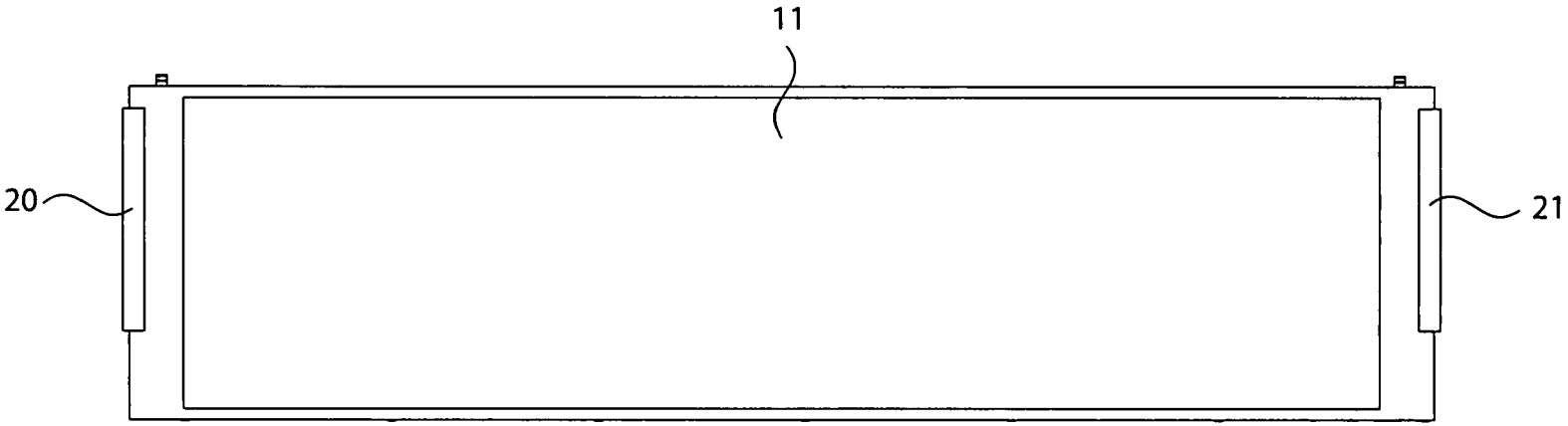
FIGS. 3 and 4 are top and front elevational views of the loading platform cooperating with the reciprocating mechanism and drive mechanism respectively.
Figure 4:
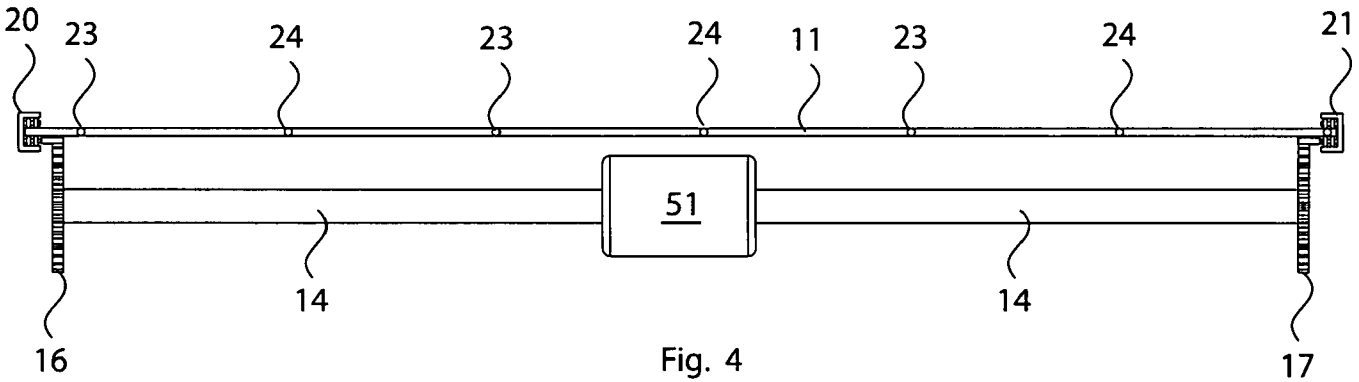
Figure 5:
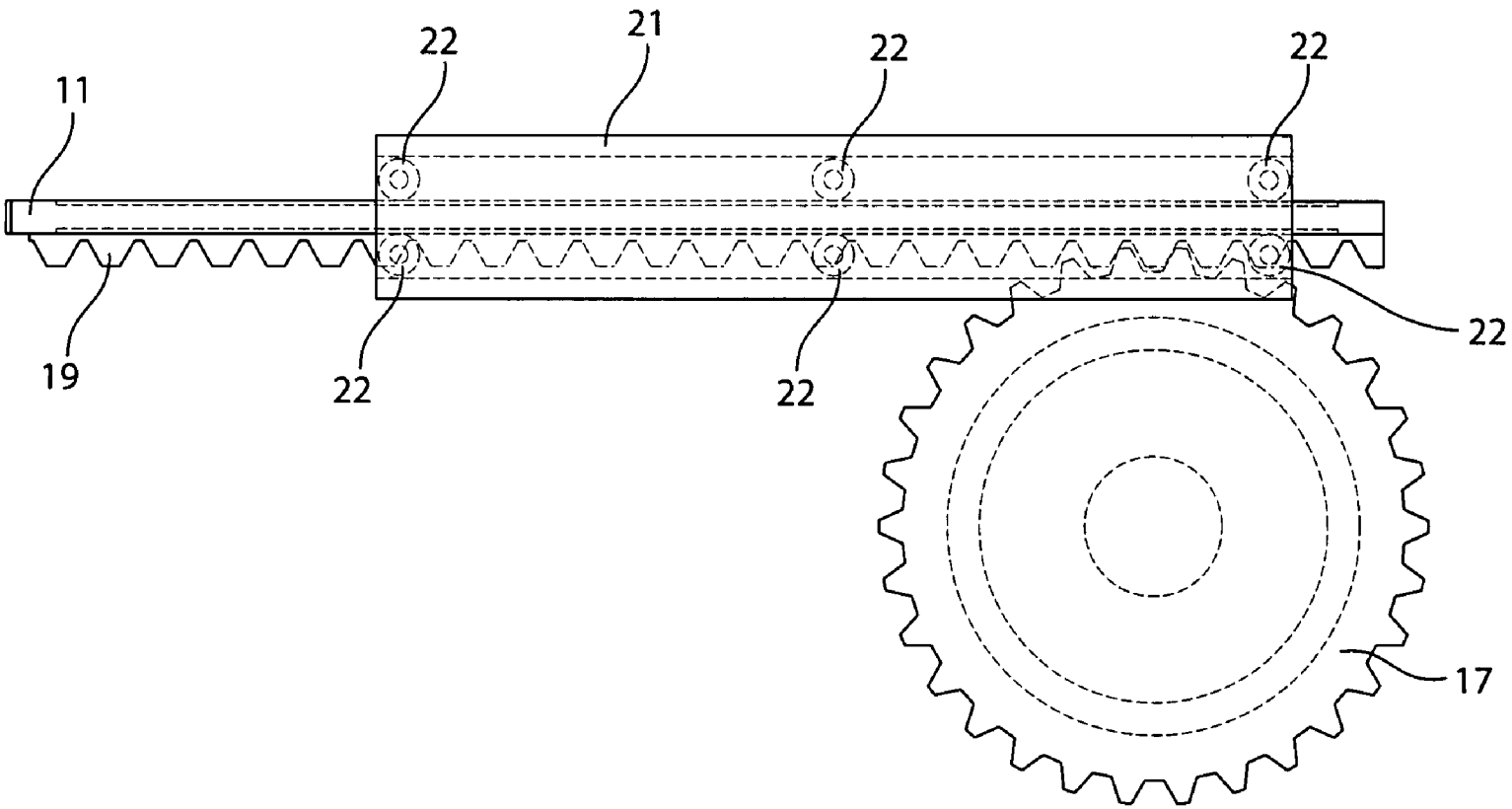
FIG. 5 is an enlarged side elevational view showing one of the cogwheels in direct abutment with the serrated track.
Figure 6:
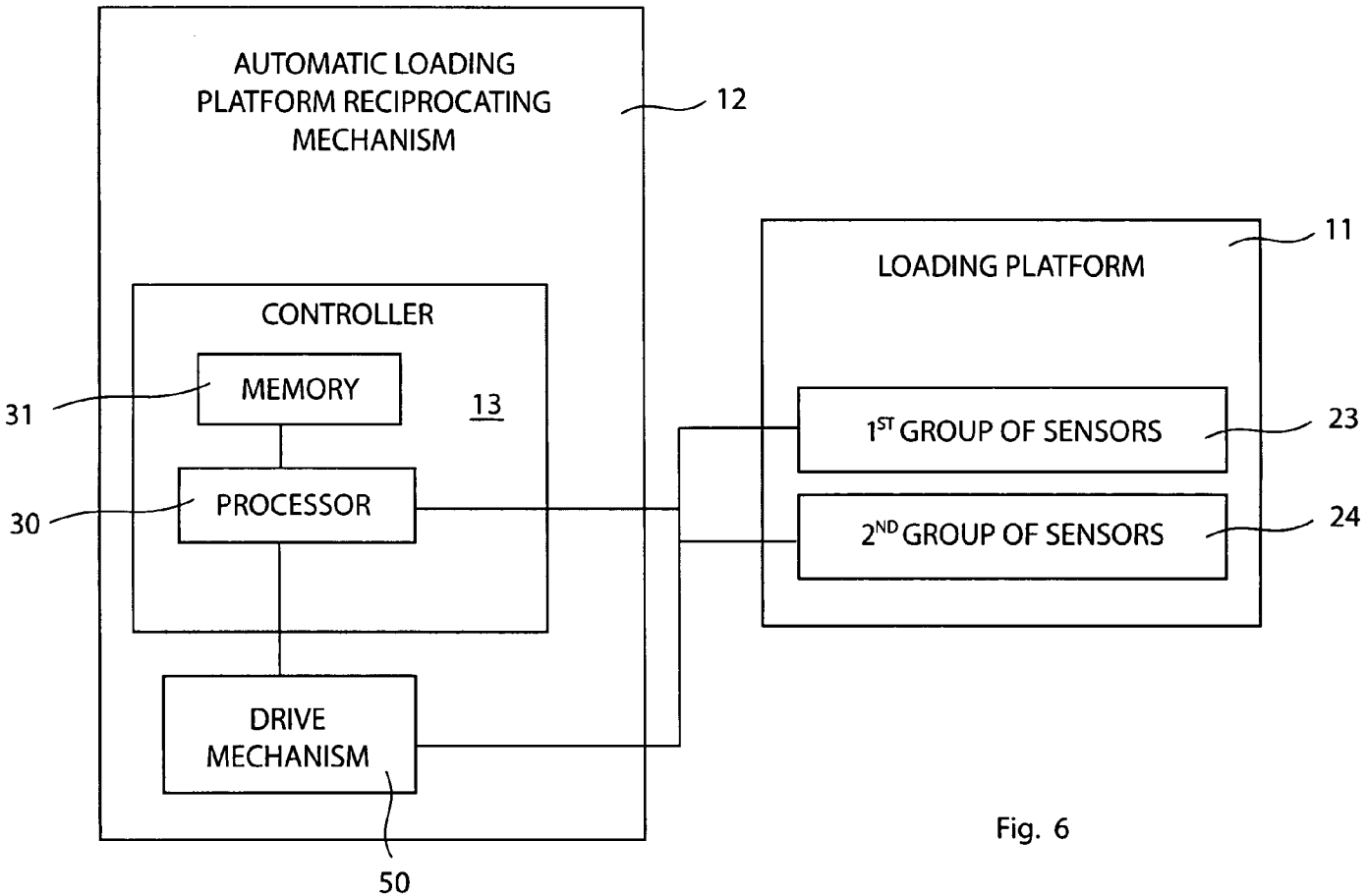
FIG. 6 is a high level schematic block diagram showing the interrelationship between the major electric components of the present invention.

The device of this invention is referred to generally in FIGS. 1-6 by the reference numeral 10 and is intended to provide an automated platform retracting device 10 for selectively bridging a gap 42 between a train door 40 and a station platform 41 during passenger loading and unloading procedures. It should be understood that the retractable platform device 10 may be used to bridge the gap between many different types of commuter trains and platforms.

The retractable platform device 10 would preclude the possibility of a passenger falling between the train door 40 and the station platform 41, and thus prevent the serious injuries. With the pressure of people behind, each of them equally intent on getting on or off, the hazards grow to unacceptable levels. As a consequence, people trip and fall, and sometimes fall between the train door 40 and platform 41.

The retractable platform device 10 is designed to bridge that gap 42 and to make such a fall impossible. Designed to move out from beneath the train door 40 an instant before they open, and to retract an instant after they close, the device 10 would operate automatically, connecting the train 43 to the loading platform 11, and providing a short but stable bridge between the two.

Still referring to FIGS. 1-6, the retractable loading platform device 10 preferably includes a rigid loading platform 11 adapted to be anchored to an underside of the train. The device 10 further includes a mechanism 12 for automatically reciprocating the loading platform 11 along a linear travel path 25 upon detecting first and second triggering events respectively. Such first and second triggering events may be defined as opening and closing operations of the train doors. However, the triggering events may also be defined when the train comes to a complete stop and begins moving thereafter, respectively.

In a preferred embodiment, the loading platform 11 may be automatically displaced from a retracted position to a fully extended position when the first triggering event is detected. The retracted position may be defined when the loading platform 11 is stored beneath the train. The fully retracted position may be defined when the loading platform 11 bridges the gap between the train and station platform. Likewise, the loading platform 11 may be automatically displaced from the fully extended position to the retracted position when the second triggering event is detected. Such a linear travel path 25 is preferably defined along a single horizontal plane aligned with the station platform 41, for example.

The automatic loading platform reciprocating mechanism 12 may include a power-actuated drive mechanism 50 centrally engaged to a bottom surface of the loading platform 11. Also, such a drive mechanism 50 may be connected to the underside of the train. Advantageously, the centrally mounted drive mechanism 50 provides not only the power-actuated input for the loading platform's 11 motions, but also provides balance to the loading platform 11. Through the connecting drive shafts 14, 15 and cogwheels 16, 17, the drive mechanism 50 serves to further anchor the remaining components of the automatic loading platform reciprocating mechanism 12 to the undercarriage of the train 43.

The automatic loading platform reciprocating mechanism 12 further includes a controller 13 provided with a processor 30 and a memory 31 electrically coupled thereto. The processor 30 may include a microprocessor or other devices capable of being programmed or configured to perform computations and instruction processing in accordance with the invention. Such other devices may include microcontrollers, digital signal processors (DSP), Complex Programmable Logic Device (CPLD), Field Programmable Gate Arrays (FPGA), application-specific integrated circuits (ASIC), discrete gate logic, and/or other integrated circuits, hardware or firmware in lieu of or in addition to a microprocessor.

Functions and process steps described herein may be performed using programmed computer devices and related hardware, peripherals, equipment and networks. When programmed, the computing devices are configured to perform functions and carry out steps in accordance with principles of the invention. Such programming may comprise operating systems, software applications, software modules, scripts, files, data, digital signal processors (DSP), application-specific integrated circuit (ASIC), discrete gate logic, or other hardware, firmware, or any conventional programmable software, collectively referred to herein as a module.

The memory 31 preferably includes programmable software instructions that are executed by the processor 30. In particular, the programmable software instructions include a plurality of chronological operating steps that define a control logic algorithm for performing the intended functions of the present invention. Such software instructions may be written in a variety of computer program languages such as C++, Fortran and Pascal, for example. One skilled in the art understands that such software instructions may contain various Boolean logic processes that perform the intended function of the present invention. Therefore, the specific source or object code of the software program is not intended to be a limiting factor in executing the present invention's intended function.

The memory 31, which enables storage of data and programs, may include RAM, ROM, flash memory and any other form of readable and writable storage medium known in the art or hereafter developed. The memory 31 may be a separate component or an integral part of another component such as processor 30. Such a memory 31 preferably includes programmable software instructions that cause the controller 13 to verify an authenticity of the first and second triggering events. Upon detecting the first and second triggering events, a first group of the sensors 23 may generate and transmit true first output signals. Similarly, a second group of the sensors 24 may generate and transmit true second output signals upon detecting the second triggering event respectively. Such first and second sensor groups 23, 24 preferably generate and transmit respective first and second false output signals when the first and second triggering events are not detected.

The plurality of sensors 23, 24 may be located at the loading platform 11 and, further, may be communicatively coupled to the controller 13 respectively. The two groups of sensors 23, 24 may include any suitably sensors. For example, motion and/or light sensors may be provided to cause the present invention to detect the first and second triggering events, for example. Active and/or passive sensors may be used to react to detectable subject matter such as light, noise, radiation (e.g., heat), or changes in emitted energy, fields or beams. However, the invention is not limited to a particular type of sensor.

Those skilled in the art will appreciate that other sensors may be used without departing from the scope of the invention. Examples of such other sensors include pressure sensitive mats; optical sensors configured to sense light; microwave sensors that use a Gunn diode operating within pre-set limits to transmit/flood a designated area/zone with an electronic field whereby movement in the zone disturbs the field and sets off an alarm; an ultrasonic sensor configured to react to a determined range of ultrasonic sound energy in a protected area; or any other sensor capable of providing motion detection capability in accordance with principles of the invention.

Advantageously, the controller 13 may cause the drive mechanism 50 to toggle between alternate operating modes upon detecting the first and second triggering events respectively. For example, the controller 13 may be responsive to the first and second outputs signals and thereby generate and transmit first and second control signals to the drive mechanism 50 upon receiving the true first and second output signals respectively. In this manner, the drive mechanism 50 is caused to rotate in clockwise and counter clockwise directions upon receiving the first and second control signals respectively.

In one embodiment, drive mechanism 50 preferably includes a rotary motor 51 coupled to an existing power source of the train 43, and a plurality of rectilinear drive shafts 14, 15 directly coupled to the rotary motor respectively. Each of such drive shafts 14, 15 may be coupled to the rotary motor 51 and oppositely extends away therefrom respectively. Notably, the drive shafts 14, 15 may be registered along a linear axis oriented parallel to a rear edge of the loading platform 11, as perhaps best shown in FIGS. 2 and 4.

The drive mechanism 12 may further include a plurality of cogwheels 16, 17 anchored to respective distal ends of the drive shafts 14, 15. Each cogwheel 16, 17 may be synchronously rotated with the drive shafts 14, 15 as the motor 51 rotates in the clockwise and counter clockwise directions. A plurality of serrated tracks 18, 19 may be statically connected directly to the bottom surface of the loading platform 11. Such serrated tracks 18, 19 are preferably configured in such a manner that the cogwheels 16, 17 remain continuously and directly engaged with the serrated tracks 18, 19 during the reciprocating motions. In this manner, the loading platform 11 is caused to linearly reciprocate along the horizontal plane as the drive shafts 14, 15 and the cogwheels 16, 17 rotate along the clockwise and counter clockwise directions respectively.

The automatic loading platform 11 reciprocating mechanism 12 may further include a plurality of protective guide rails 20, 21 situated at opposed lateral ends of the loading platform 11 respectively. A plurality of guide wheels 22 may be rotatably anchored within each of the protective guide rails 20, 21. Such guide wheels 22 are preferably configured in such a manner that the loading platform 11 remains intercalated between top and bottom rows of the guide wheels 22 while reciprocating between the retracted and fully extended positions respectively.

In one embodiment, each of the protective guide rails 20, 21 has a longitudinal length registered parallel to the linear travel path 25 of the loading platform 11 for maintaining the loading platform 11 at a substantially stable position during repeated reciprocating movement.

For any hurried commuter—and especially for those elderly or mobility-restricted commuters for whom these transitions are a particular obstacle—the retractable loading platform device 10 would provide a convenient, reliable safety bridge between train and platform, platform and train.

The present invention further includes a method of utilizing a retractable loading platform device 10 for bridging a gap between a train 43 and a station platform 41 during passenger loading and unloading procedures. Such a method preferably includes the chronological steps of: providing and anchoring a rigid loading platform 11 to an underside of the train 43; and automatically reciprocating the loading platform 11 along a linear travel path 25 upon detecting first and second triggering events respectively.

The later step may be executed by performing the following chronological steps: automatically displacing the loading platform 11 from a retracted position to a fully extended position when the first triggering event is detected; and automatically displacing the loading platform 11 from the fully extended position to the retracted position when the second triggering event is detected. Such a linear travel path 25 is preferably defined along a single horizontal plane.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A retractable loading platform assembly for bridging a gap between a train and a station platform during passenger loading and unloading procedures, said retractable loading platform assembly comprising:

a loading platform adapted to be anchored to an underside of the train; and means for automatically reciprocating said loading platform along a linear travel path upon detecting first and second triggering events respectively;

wherein said loading platform is displaced from a retracted position to a fully extended position when said first triggering event is detected;

wherein said loading platform is displaced from the fully extended position to the retracted position when said second triggering event is detected;

wherein said linear travel path is defined along a single horizontal plane;

wherein said automatic loading platform reciprocating means comprises a power-actuated drive mechanism centrally engaged to a bottom surface of said loading platform, said drive mechanism adapted to be connected to the underside of the train;

a controller including a processor and a memory electrically coupled thereto; and a plurality of sensors located at said loading platform and being communicatively coupled to said controller respectively;

wherein said controller causes said drive mechanism to toggle between alternate operating modes upon detecting said first and second triggering events respectively.

wherein said memory comprises: programmable software instructions that cause said controller to verify an authenticity of said first and second triggering events;

wherein a first group of said sensors generates and transmits true first output signals upon detecting said first triggering event respectively, a second group of said sensors generating and transmitting true second output signals upon detecting said second triggering event respectively;

wherein said first and second sensor groups generates and transmits respective first and second false output signals when said first and second triggering events are not detected;

wherein said controller is responsive to said first and second outputs signals and thereby generates and transmits first and second control signals to said drive mechanism upon receiving said true first and second output signals respectively;

wherein said drive mechanism is caused to rotate in clockwise and counter clockwise directions upon receiving said first and second control signals respectively;

wherein said drive mechanism comprises:

a rotary motor adapted to be coupled to an existing power source of the train;

a plurality of rectilinear drive shafts directly coupled to said rotary motor respectively, each of said drive shafts being coupled to said rotary motor and oppositely extending away therefrom respectively, said drive shafts being registered along a linear axis oriented parallel to a rear edge of said loading platform;

a plurality of cogwheels anchored to respective distal ends of said drive shafts, each of said cogwheels being synchronously rotated with said drive shafts as said motor rotates in the clockwise and counter clockwise directions; and a plurality of serrated tracks statically connected directly to said bottom surface of said loading platform, said serrated tracks being configured in such a manner that said cogwheels remain continuously and directly engaged with said serrated tracks during the reciprocating motions.

2. The retractable loading platform assembly of claim 1, wherein said loading platform is caused to linearly reciprocate along said horizontal plane as said drive shafts and said cogwheels rotate along the clockwise and counter clockwise directions respectively.

3. The retractable loading platform assembly of claim 1, wherein said automatic loading platform reciprocating means further comprises:

a plurality of protective guide rails situated at opposed lateral ends of said loading platform respectively; and a plurality of guide wheels rotatably anchored within each of said protective guide rails, said guide wheels being configured in such a manner that said loading platform remains intercalated between top and bottom rows of said guide wheels while reciprocating between the retracted and fully extended positions respectively.

4. The retractable loading platform assembly of claim 1, wherein each of said protective guide rails has a longitudinal length registered parallel to said linear travel path of said loading platform for maintaining said loading platform at a substantially stable position during repeated reciprocating movement.

5. A retractable loading platform assembly for bridging a gap between a train and a station platform during passenger loading and unloading procedures, said retractable loading platform assembly comprising:

a rigid loading platform adapted to be anchored to an underside of the train; and means for automatically reciprocating said loading platform along a linear travel path upon detecting first and second triggering events respectively;

wherein said loading platform is automatically displaced from a retracted position to a fully extended position when said first triggering event is detected;

wherein said loading platform is automatically displaced from the fully extended position to the retracted position when said second triggering event is detected;

wherein said linear travel path is defined along a single horizontal plane;

wherein said automatic loading platform reciprocating means comprises a power-actuated drive mechanism centrally engaged to a bottom surface of said loading platform, said drive mechanism adapted to be connected to the underside of the train;

a controller including a processor and a memory electrically coupled thereto; and a plurality of sensors located at said loading platform and being communicatively coupled to said controller respectively;

wherein said controller causes said drive mechanism to toggle between alternate operating modes upon detecting said first and second triggering events respectively;

wherein said memory comprises: programmable software instructions that cause said controller to verify an authenticity of said first and second triggering events;

wherein a first group of said sensors generates and transmits true first output signals upon detecting said first triggering event respectively, a second group of said sensors generating and transmitting true second output signals upon detecting said second triggering event respectively;

wherein said first and second sensor groups generates and transmits respective first and second false output signals when said first and second triggering events are not detected;

wherein said controller is responsive to said first and second outputs signals and thereby generates and transmits first and second control signals to said drive mechanism upon receiving said true first and second output signals respectively;

wherein said drive mechanism is caused to rotate in clockwise and counter clockwise directions upon receiving said first and second control signals respectively;

wherein said drive mechanism comprises:

a rotary motor adapted to be coupled to an existing power source of the train;

a plurality of rectilinear drive shafts directly coupled to said rotary motor respectively, each of said drive shafts being coupled to said rotary motor and oppositely extending away therefrom respectively, said drive shafts being registered along a linear axis oriented parallel to a rear edge of said loading platform;

a plurality of cogwheels anchored to respective distal ends of said drive shafts, each of said cogwheels being synchronously rotated with said drive shafts as said motor rotates in the clockwise and counter clockwise directions; and a plurality of serrated tracks statically connected directly to said bottom surface of said loading platform, said serrated tracks being configured in such a manner that said cogwheels remain continuously and directly engaged with said serrated tracks during the reciprocating motions.

6. The retractable loading platform assembly of claim 5, wherein said loading platform is caused to linearly reciprocate along said horizontal plane as said drive shafts and said cogwheels rotate along the clockwise and counter clockwise directions respectively.

7. The retractable loading platform assembly of claim 5, wherein said automatic loading platform reciprocating means further comprises:

a plurality of protective guide rails situated at opposed lateral ends of said loading platform respectively; and a plurality of guide wheels rotatably anchored within each of said protective guide rails, said guide wheels being configured in such a manner that said loading platform remains intercalated between top and bottom rows of said guide wheels while reciprocating between the retracted and fully extended positions respectively.

8. The retractable loading platform assembly of claim 5, wherein each of said protective guide rails has a longitudinal length registered parallel to said linear travel path of said loading platform for maintaining said loading platform at a substantially stable position during repeated reciprocating movement.

* * * * *